US005548883A

United States Patent [19]

Saijo et al.

[11] Patent Number: 5,548,883

[45] Date of Patent: Aug. 27, 1996

[54] APPARATUS FOR EXECUTING HEMMING PROCESS

[75] Inventors: Juzo Saijo; Koji Ochiai, both of Nagoya, Japan

[73] Assignee: Sanyo Machine Works, Ltd., Aichi-ken, Japan

[21] Appl. No.: 293,302

[22] Filed: Aug. 22, 1994

Related U.S. Application Data

[62] Division of Ser. No. 93,945, Jul. 21, 1993.

[30] Foreign Application Priority Data

Nov. 19, 1992 [JP] Japan ..... 4-309929

[51] Int. Cl.[6] ..... B23P 11/00

[52] U.S. Cl. ..... 29/243.5; 72/379.2

[58] Field of Search ..... 29/243.5, 243.517, 29/509; 72/379.2

[56] References Cited

U.S. PATENT DOCUMENTS

| | | | |
|---|---|---|---|
| 638,554 | 12/1899 | Burton | 29/243.5 X |
| 2,235,090 | 3/1941 | Stall et al. | 72/379.2 |
| 2,707,510 | 5/1955 | Gershon | 72/379.2 |

FOREIGN PATENT DOCUMENTS

| | | | |
|---|---|---|---|
| 1260187 | 3/1961 | France | 72/379.2 |
| 461760 | 4/1975 | U.S.S.R. | 72/379.2 |

*Primary Examiner*—Joseph M. Gorski

*Attorney, Agent, or Firm*—Pollock, Vande Sande & Priddy

[57] ABSTRACT

An apparatus is presented for hemming at least two panels together. An inner panel, having a rounded corner, is initially positioned onto an outer panel, also having a rounded corner, the rounded corners of the panels overlapping. The rounded corner of the inner panel is also preliminarily positioned against a rounded, corner hem flange of the outer panel. The apparatus includes a creasing blade, having a concave rounded corner, which is brought toward an external surface of the hem flange. Contact occurs between the outer surface of the hem flange and the concave rounded corner of the creasing blade. The hem flange is then pressured by the rounded corner of the creasing blade, thereby preliminarily folding the outer panel hem flange over the inner panel by an acute angle. The creasing blade is withdrawn form the hem flange. The acutely angled fold of the outer panel hem flange is subsequently pressed by the flat surface of a final folding blade, until the hem flange crimps the inner panel.

3 Claims, 7 Drawing Sheets

APPARATUS FOR EXECUTING HEMMING PROCESS

This application is a divisional of U.S. patent application Ser. No. 08/093,945, filed Jul. 21, 1993.

BACKGROUND OF THE INVENTION

The present invention relates to a method of executing a hemming process for folding a hem flange of an outer panel and combining an inner panel therewith and an apparatus for implementing this method in the course of manufacturing an external plate body like a hood, fenders, side-doors, and a luggage room, of an automotive body, for example.

For instance, when processing an external plate body such as a hood, fenders, side-doors, or the like, available for assembling an automotive body, a hem flange formed at an edge of an outer panel is folded in the backward direction to cause the folded hem flange to nip an edge of an inner panel in order to combine both panels with each other. Conventionally, this method is called the "hemming process". Concretely, as shown in FIG. 7, a hem flange 11*a* is previously formed at an edge of an outer panel 11 by erecting it at a substantially right angle. Next, an edge of an inner panel 12 is superposed on the inner surface of the hem flange 11*a*, and then a preliminary folding process is executed against the superposed hem flange 11*a* by a predetermined folding angle by operating a preliminary-folding blade 13. Finally, the hem flange 11*a* is regularly folded by means of a regular folding blade 15.

However, when executing a hemming process, generally, how to process corner domain of the hem flange 11*a* is an important problem. This is because, in the course of folding corner domain of the hem flange 11*a* backward in the direction of an edge of an inner panel, a certain excessive substance is naturally generated to inevitably result in the generation of numerous creases. Once numerous creases are generated, it not only spoils external appearance, but it also causes part of the creases to protrude from the contour of the corner domain to eventually generate a security problem. Furthermore, deformation may be generated on the external surface of an outer panel.

To prevent those critical problems from occurrence, as shown in FIG. 8, conventionally, the dimension of corner domain 11*a*1 is reduced so that depth S3 of the hem flange 11*a* can extremely be contracted from the other depth S4 of peripheral domains other than the corner domain 11*a*1, thus decreasing the amount of excessive substance of the corner domain 11*a*1.

Furthermore, as shown in FIG. 9, any of those conventional folding methods terminates the preliminary folding process without further executing a regular folding process against the corner domain 11*a*1.

Nevertheless, according to such a conventional method cited above, although a crease can be prevented from occurrence in the corner domain, since this conventional method deletes the regular folding process, special treatment is discretely needed in order to fill up clearance between the corner domain 11*a*1 and the inner panel 2 with a sealing agent or paint, thus increasing an additional step. Desirably, such an additional step should be eliminated.

SUMMARY OF THE INVENTION

Therefore, the object of the invention is to fully solve those technical problems cited above in the course of processing the corner domain of a hem flange during the hemming process.

The hemming process according to claim 1 is consummated by sequentially executing those steps described below. Initially, a hem flange formed at an edge of an outer panel is preliminarily folded in the direction of an edge of an inner panel. Next, a regular folding process is executed against the preliminarily folded hem flange by further exerting pressurized force thereto. Finally, the hem flange of the outer panel is folded backward in order to nip the inner panel. Only partial domain of the corner substance is deformed by locally exerting pressurizing force to it at the initial stage of the preliminary folding process executed against the corner domain.

The hemming apparatus according to claim 2 is provided with a preliminary-folding blade for preliminarily folding recessed and rounded corner of a hem flange formed at an edge of an outer panel, where the preliminary-folding blade has a pressurizing surface which is provided with recessed and rounded shape having curvature substantially being equal to that of the corner domain and projected initial pressurizing domain formed thereon.

As a result of a variety of tests carried out by the Applicant of the invention, it was confirmed that creases caused by surplus amount of substance were always present in such domain where the substance initially incurred deformation. It was also confirmed that, whenever applying such load that might facilitate growth of creases, these creases grew themselves by way of solely concentrating on the domain where the substance initially deformed. Probably, this is because, since the yield point of specific domain incurring initial deformation to the substance is lowered from the yield point of other domains, when such a domain comprising surplus substance receives pressure, certain forces aiming to be out of pressurized surface concentrates on the domain containing lowered yield point. In other words, by locally lowering the yield point of specific domain of the substance during the initial stage of the pressurizing process, it is possible that creases can be generated and grown by way of concentrating on this specific domain.

DESCRIPTION OF THE PREFERRED EMBODIMENTS

Referring now to the accompanying drawings, a novel method of executing a hemming process according to an embodiment of the invention is described below.

Figure 1A:
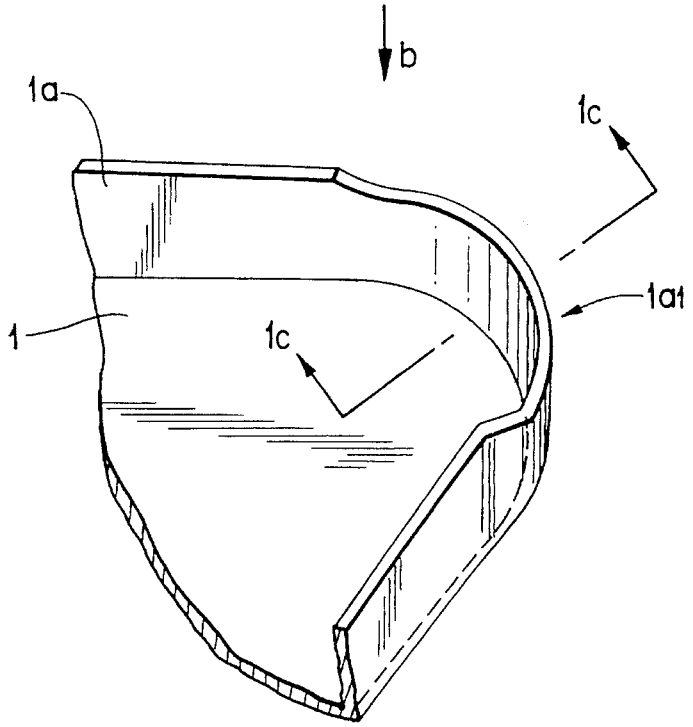
FIG. 1*a* is a perspective view of the corner domain of a hem flange related to the invention.
Figure 1B:
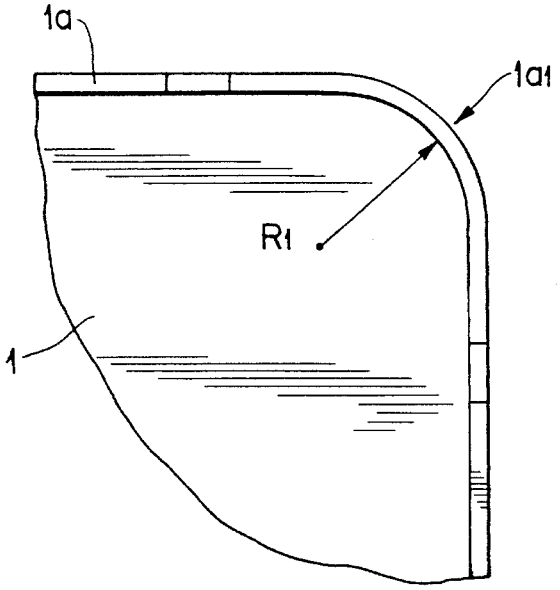
FIG. 1*b* is a plan of the corner domain shown in FIG. 1*a;*
Figure 1C:
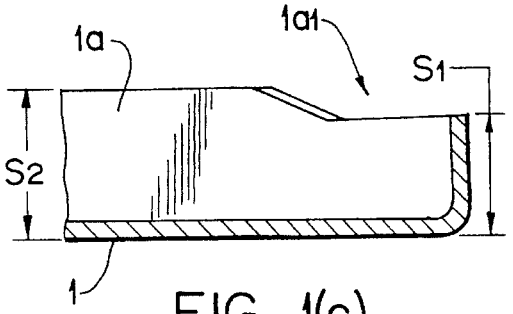
FIG. 1*c* is a sectional view of the corner domain along line c—c shown in FIG. 1*a;*

FIG. 1 schematically illustrates the corner domain **1*a*1 of a hem flange 1*a* formed at an edge of an outer panel 1. The hem flange 1*a* is previously formed along an edge of the outer panel 1** by way of being erected at a substantially right angle. As shown in FIG. 1*b*, the corner domain **1*a*1 of the hem flange 1*a*** is of recessed and rounded shape having a radius of curvature R1. As shown in FIG. 1*c*, the flange depth S1 is slightly less than the other flange depth S2 of peripheral domains other than the corner domain **1*a*1. Although an embodiment of the invention decreases the substance of the corner domain 1*a*1** in the same way as is conventionally done, the decreased amount of the substance is not as much as that of the conventional practice.

Figure 2A:
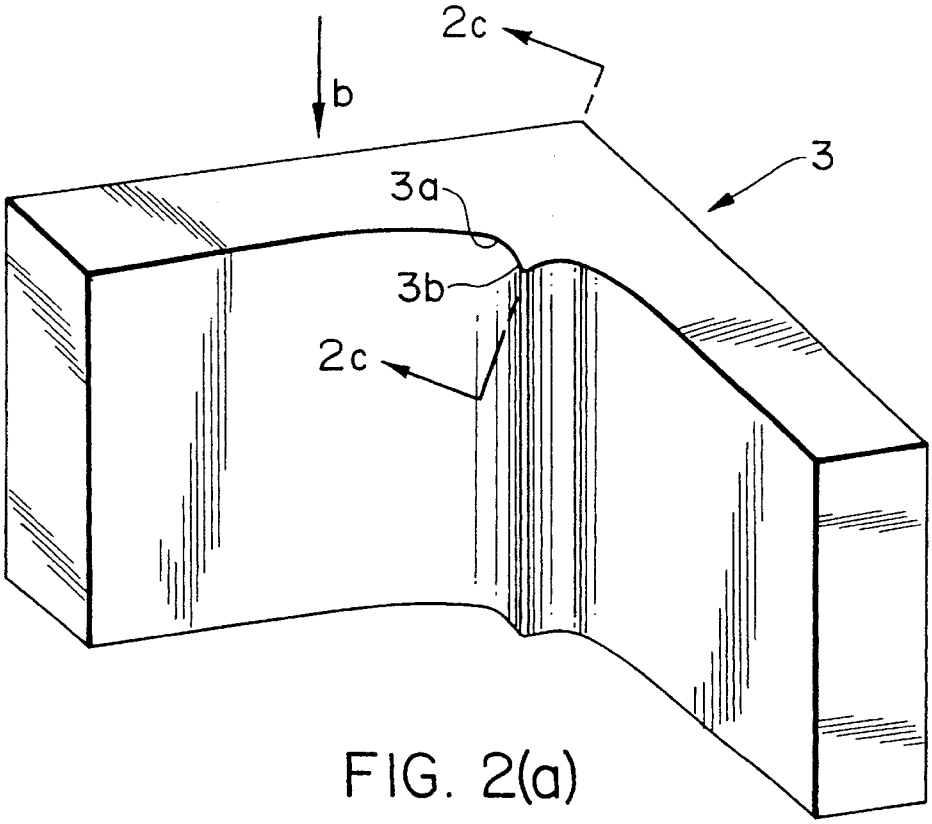
FIG. 2*a* is a perspective view of a preliminary-folding blade related to the invention.
Figure 2B:
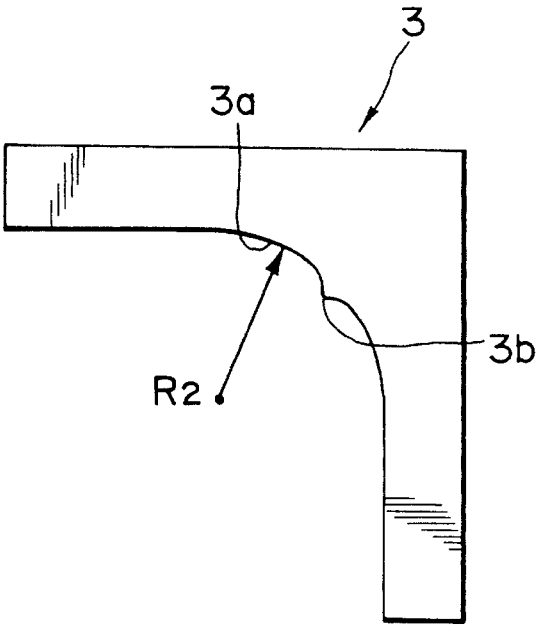
FIG. 2*b* is a plan of the preliminarily folding blade shown in FIG. 2*a;*
Figure 2C:
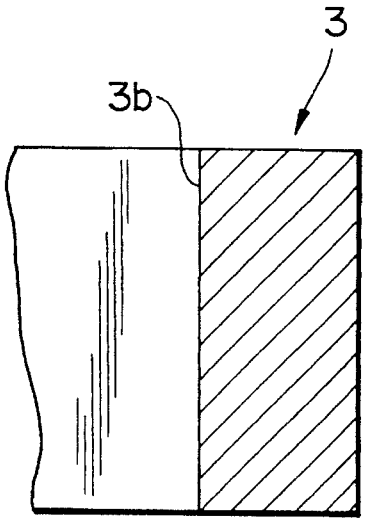
FIG. 2*c* is a sectional view of the preliminary-folding blade along line c—c shown in FIG. 2*a;*

FIG. 2 schematically illustrates a preliminary folding blade 3 which is used for preliminarily folding the corner domain **1*a*1**. As shown in FIG. 2*b*, the preliminary folding blade 3 comprises a recessed and rounded surface **3*a* drawn by a radius of curvature R2 of the corner domain 1*a*1 and a projected initial pressurizing domain 3*b* (cosp) which is integrally formed in the substantially center domain of the pressurizing domain 3*a*. Although the initial pressurizing domain 3*b*** shown in FIGS. 2*a* and 2*b* has triangular section and extends in the direction of the depth of the pressurizing surface **3*a*, the structure of this domain 3*b*** is not solely limited to the one described above.

Figure 3A:
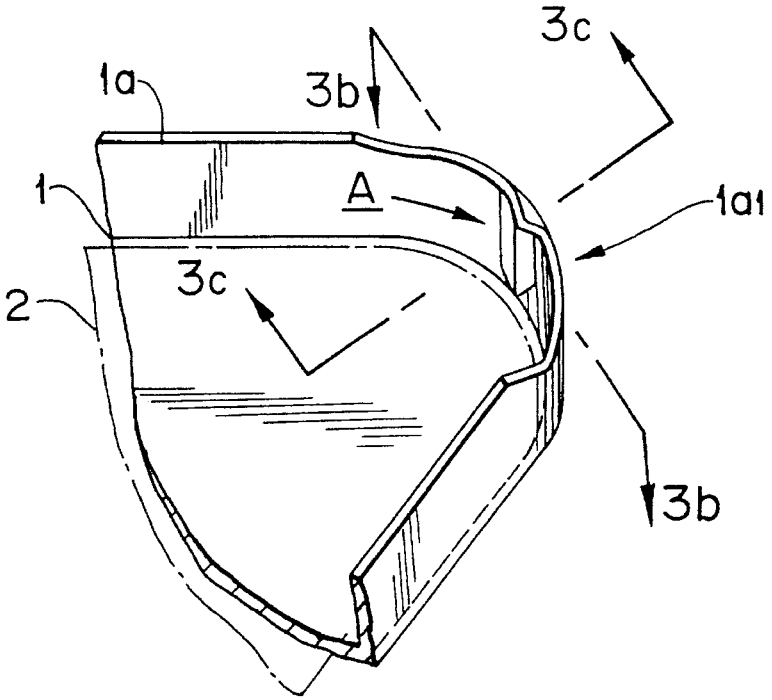
FIG. 3*a* is a perspective view of the corner domain of a hem flange at the initial stage of preliminary folding process related to the invention.
Figure 3B:
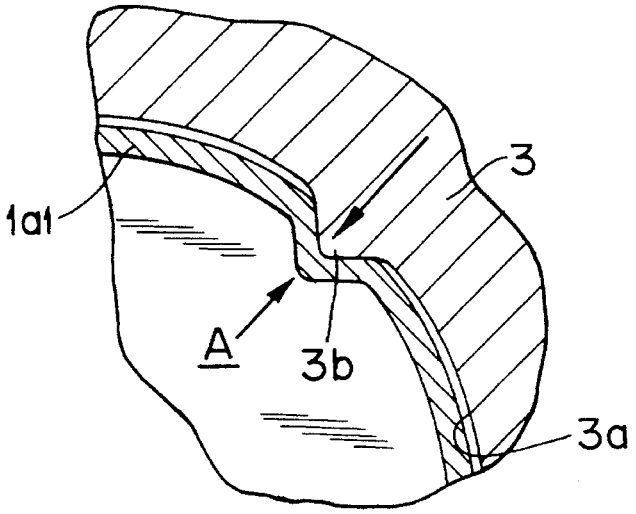
FIG. 3*b* is a sectional view of the corner domain along line b—b shown in FIG. 3*a;*
Figure 3C:
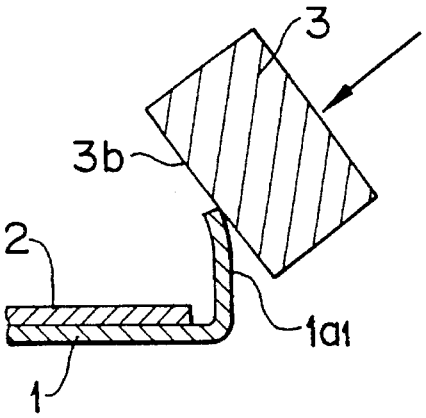
FIG. 3*c* is a sectional view of the corner domain along line c—c shown in FIG. 3*a;*

FIG. 3 schematically illustrates the initial state of the preliminary folding of the corner domain **1*a*1 of the hem flange 1*a* via operation of a preliminary folding blade 3 by causing the recessed and rounded pressurizing surface 3*a* of the preliminary folding blade 3 to pressurize the projected and rounded corner domain 1*a*1 in order to preliminarily fold the corner domain 1*a*1 by a predetermined folding angle θ1 onto an edge of an inner panel 2. Since a projected initial pressurizing domain 3*b* is formed on the pressurizing surface 3*a* of the preliminary folding blade 3, only the initial pressurizing domain 3*b* comes into contact with the corner domain 1*a*1** during the initial stage of the preliminary folding process. In consequence, as shown in FIG. 3*b*, the corner domain **1*a*1 is locally pressurized by the initial pressurizing domain 3*b***, thus causing only the pressurized domain A to incur deformation (a cuspal crease).

Figure 4A:
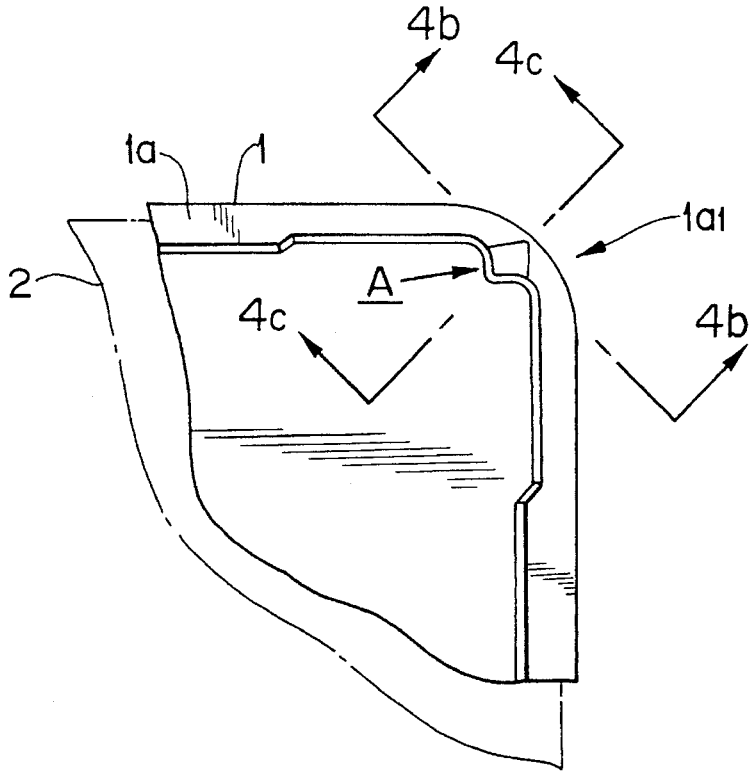
FIG. 4*a* is a perspective view of the corner domain of a hem flange at the final stage of preliminary-folding process related to the invention.
Figure 4B:
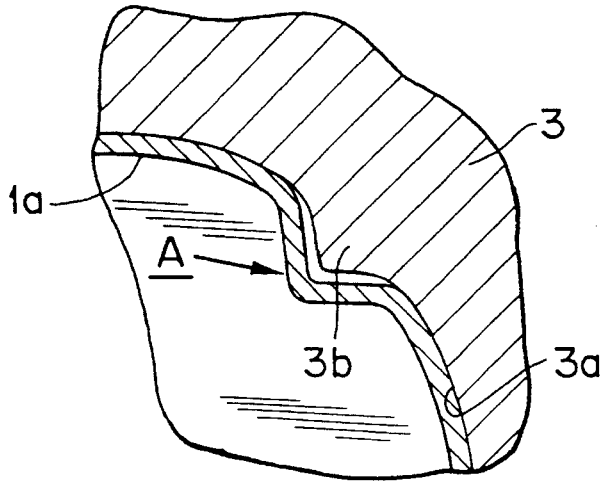
FIG. 4*b* is a sectional view of the corner domain along line b—b shown in FIG. 4*a;*
Figure 4C:
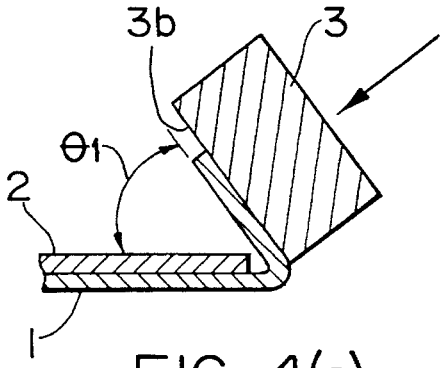
FIG. 4*c* is a sectional view of the corner domain along line c—c shown in FIG. 4*a;*

FIG. 4 schematically illustrates the final state of the preliminary folding process executed by the preliminary folding blade 3. By continuously exerting pressurizing force against the preliminary folding blade 3 further from the state shown in FIG. 3, the pressurizing surface **3*a* of the preliminary folding blade 3 comes into contact with the corner domain 1*a*1 to pressurize the entire corner domain 1*a*1. Upon receipt of pressurizing force from the pressurizing surface 3*a* of the preliminary folding blade 3, the corner domain 1*a*1 is folded in the direction of an edge of the inner panel 2 by a predetermined folding angle θ1. Concurrently, deformation slightly grows in the pressurized domain A after initially being pressurized by the initial pressurizing domain 3*b***.

Figure 5A:
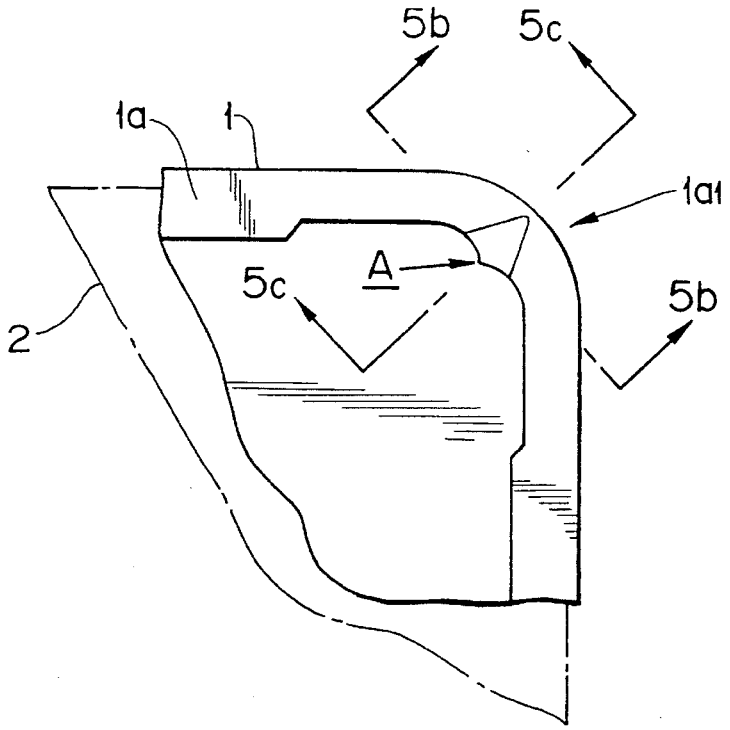
FIG. 5*a* is a perspective view of the corner domain of a hem flange at the final stage of the regular folding process related to the invention.
Figure 5B:
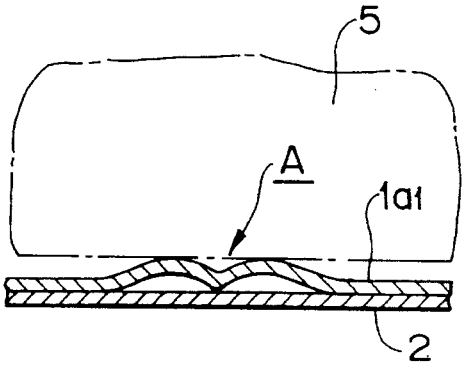
FIG. 5*b* is a sectional view of the corner domain along line b—b shown in FIG. 5*a;*
Figure 5C:
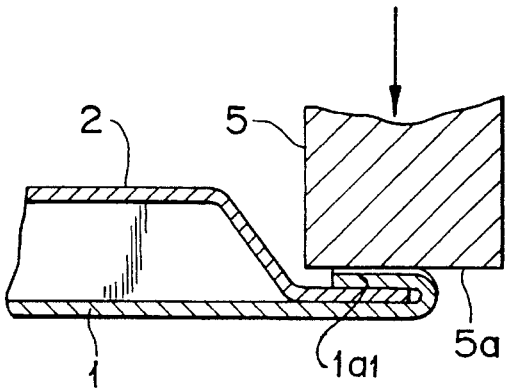
FIG. 5*c* is a sectional view of the corner domain along line c—c shown in FIG. 5*a;*

FIG. 5 schematically illustrates the final stage of the regular folding process executed by a regular folding blade 5 having a conventional structure. The corner domain **1*a*1 is fully folded by activating the regular folding blade 5 to further exert pressurizing force against the corner domain 1*a*1 previously being folded by the preliminary folding blade 3 by a predetermined folding angle θ1 before the corner domain 1*a*1 is eventually folded back onto the edge of the inner panel 2 to implement a regular folding process. When the corner domain 1*a*1 is fully folded backward, the edge of the inner panel 2 is nipped by the fully-folded corner domain 1*a*1 to combine the outer and inner panels 1 and 2** with each other. As shown in FIG. 5*b*, creases generated by surplus substance of the corner domain **1*a*1 concentrically grow themselves in the pressurized domain A which was initially pressurized and deformed by the initial pressurizing domain 3*b* during the initial stage of the preliminary folding process. The pressurized domain substantially curves inwards. Surplus substance of the corner domain 1*a*1 mildly continues from the pressurized domain A by way of curving itself in the outward direction. It was confirmed that no crease was generated in other domains. In consequence, compared to the conventional effect, the combined outer and inner panels 1 and 2** proved a far better appearance, and yet, fully solved the security problem mentioned earlier.

It is acknowledged that the wider the curved angle θ1, the greater the amount of surplus substance generated in the corner domain **1*a*1. Upon receipt of pressurizing force from the regular folding blade 5, the surplus substance aims to be out of the pressurized surface 5*a*. The force aiming to be out of the pressurized surface 5*a* concentrically acts as contracted stress upon a specific domain which initially generated creases (in other words, deformation) to cause creases to grow furthermore. In this way, creases are generated in the specific domain A of the corner domain 1*a*1** during the initial pressurizing stage to cause creases to continuously grow themselves in the specific domain A in association with furtherance of the regular folding process. In consequence, the regular folding process is properly executed without causing creases to be generated in other domains at all.

Figure 6:
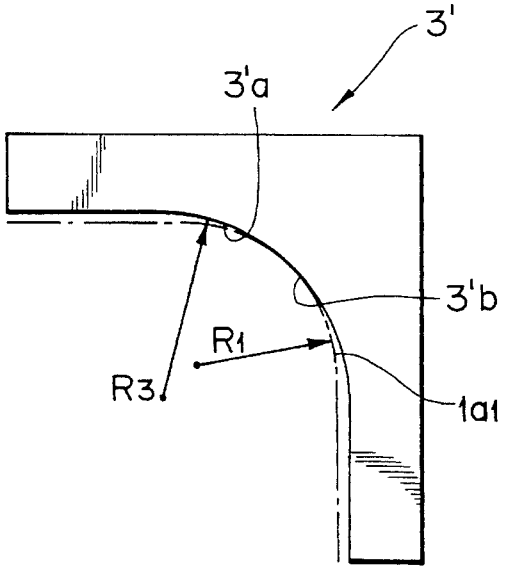
FIG. 6 is a plan of the preliminary-folding blade according to another embodiment of the invention.
Figure 7A:
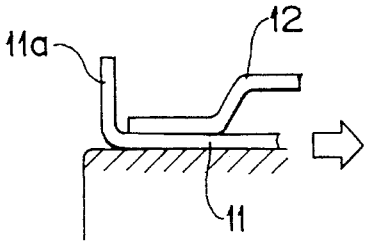
FIGS. 7(*a*), 7(*b*) and 7(*c*), hereinafter collectively referred to as "FIG. 7" is a conceptive view denoting a general aspect of the hemming process related to the invention.
Figure 7B:
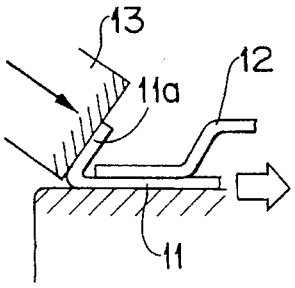
Figure 7C:
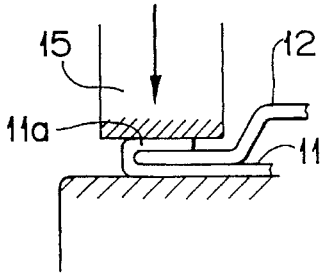
Figure 8A:
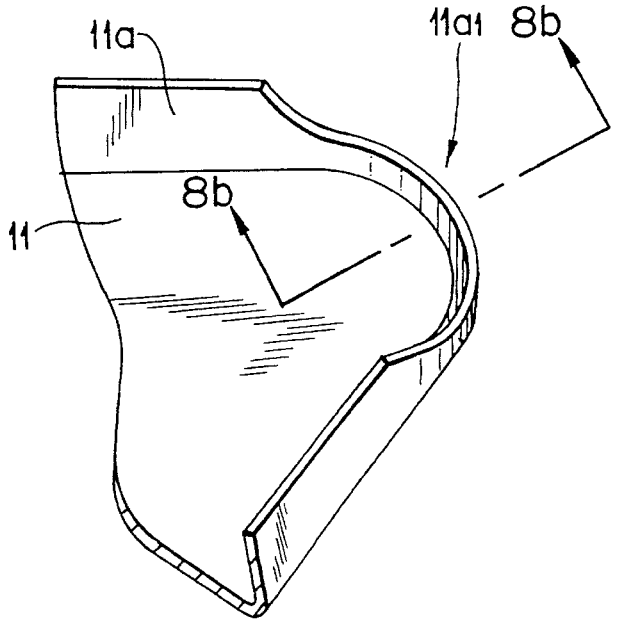
FIG. 8(a) PRIOR ART
FIG. 8*a* is a perspective view of the conventional corner domain of a hem flange.
Figure 8B:
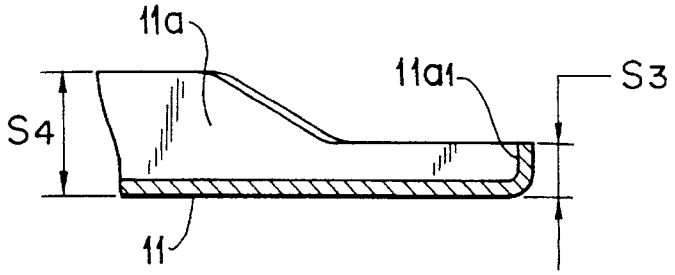
FIG. 8(b) PRIOR ART
FIG. 8*b* is a sectional view of the conventional corner domain along line b—b shown in FIG. 8*a*.
Figure 9:
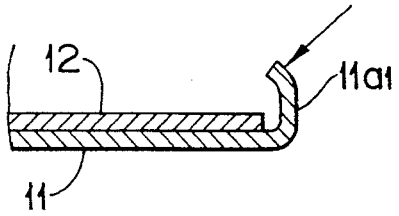
FIG. 9 PRIOR ART
FIG. 9 is a sectional view denoting the final stage of a conventional method of processing the conventional corner domain of a hem flange.

Another embodiment shown in FIG. 6 provides curvature (concretely, radius of curvature R3) for the pressurizing surface 3'a of a preliminary folding blade 3', where the curvature R3 is greater than the other curvature (concretely, radius of curvature R1) provided for the corner domain **1*a*1. This embodiment generates such functional effect identical to that is generated by the preceding embodiment by causing the substantial center domain 3'b of the pressurizing surface 3'** to solely come into contact with part of the corner domain

1a1 during the initial stage of the preliminary folding process. Therefore, whenever operating the preliminary folding blade 3', the center domain 3' of the pressurizing surface 3'a serves as the initial pressurizing domain which initially pressurizes to partly deform domain A of the corner domain 1a1.

As shown in FIG. 1a, those embodiments described above respectively take off part of the substance of the corner domain 1a1. Alternatively, the invention also permits to execute those sequential processes described below by way of deleting execution of the removal of part of the substance of the corner domain 1a1, in other words, by way of maintaining a state of the flange depth denoted by S1=S2. Even when the flange depth S1 and S2 are equal to each other, the invention can still achieve such functional effect identical to that which is achieved by those preceding embodiments described above. The essential content of the,invention is to eventually cause creases to be generated and grown concentrically in a specific domain by locally lowering the yield point of this domain of material substance at the initial stage of the preliminary folding process. Therefore, for example, it is theoretically possible to generate such functional effect identical to that is achieved by the invention by previously forming extremely fine slits in the flange-protruding direction in such a case in which the corner domain contains fine slits in external corner and thin thickness.

As is apparent from the above description, the object of the invention is to concentrically generate and grow numerous creases from surplus substance of the corner domain of a hem flange in partial domain of the corner area by defining this partial corner by solely and locally pressurizing it during the initial stage of the preliminary folding process executed against the corner domain. Therefore, according to the invention, even when executing the regular folding process without extremely contracting flange dimension of the corner, the resulting product can be provided with far better appearance than any of those conventional products. At the same time, the method according to the invention can securely eliminate faulty effects such as unwanted protrusion of part of creases from the contour of the corner domain or unwanted generation of abnormal deformation on the external surface of the outer panel, or the like. Furthermore, the method according to the invention dispenses with such an additional step otherwise needed to fill up clearance between the corner domain and the inner panel with sealing agent or paint normally needed to implement any conventional method because the conventional method terminates the corner-domain processing work as of the preliminary folding process. In consequence, the novel method according to the invention securely promotes operating efficiency as well.

What is claimed is:

1. An apparatus for hemming a panel assembly together, the assembly including an inner panel, having a rounded corner, and positioned on an outer panel which also has a rounded corner, the rounded corners of the panels overlapping, and the rounded corner of the inner panel butted against a rounded, corner hem flange of the outer panel, the apparatus comprising:

creasing blade means, having a concave rounded corner and a medially located single projecting cusp formation which extends from the top to the bottom of the concave rounded corner, for pressing a single cuspal crease into a corresponding corner in the outer surface of the hem flange, the crease being perpendicular to the inner panel, the creasing blade means preliminarily folding the outer panel hem flange inwardly over the inner panel by an acute angle; and final folding blade means having a flat surface for pressing against the acutely angled hem flange for crimping the inner panel.

2. The apparatus set forth in claim 1 wherein the hem flange comprises a stepped down height between perpendicular sides and an intermediate rounded corner of the flange.

3. The apparatus set forth in claim 1 wherein the hem flange comprises an inclined edge between perpendicular sides and an intermediate rounded corner of the flange.

* * * * *